United States Patent [19]

Miller et al.

[11] 4,337,904

[45] Jul. 6, 1982

[54] WEB TENSION CONTROL METHOD AND APPARATUS

[75] Inventors: Peter S. Miller, Waterville; Jack H. Myers, Toledo, both of Ohio

[73] Assignee: Owens-Illinois, Inc., Toledo, Ohio

[21] Appl. No.: 199,172

[22] Filed: Oct. 22, 1980

[51] Int. Cl.[3] ..... B65H 59/00; B65H 19/08

[52] U.S. Cl. ..... 242/75.53; 156/504; 226/195

[58] Field of Search ..... 242/75.53, 75.4, 75.43, 242/75.44, 75.41, 58.1, 58.4; 226/195, 44, 38, 189; 156/564

[56] References Cited

U.S. PATENT DOCUMENTS

| | | | |
|---|---|---|---|
| 1,936,916 | 11/1933 | Richter | 242/75.43 |
| 2,623,703 | 12/1952 | Laycock | 242/25.43 |
| 3,822,838 | 7/1974 | Butler | 242/75.44 |
| 3,862,729 | 1/1975 | Johnson | 242/75.43 |

*Primary Examiner*—Edward J. McCarthy

*Attorney, Agent, or Firm*—John R. Nelson; Myron E. Click; David H. Wilson

[57] ABSTRACT

This invention provides an improved method and apparatus for controlling the tension in a tensionally fragile web of material being pulled by a constant speed processing machine from either one of a pair of supply rolls. A first festooning roller effects the control of the web tension during the normal operation of the machine. During the splicing of the web from one supply roll to another, the tension in the web would tend to dramatically increase. This tendency is offset by a second festooning roller engageable with the web and shiftable in a web tension decreasing direction only upon the occurrence of web tensions substantially in excess of the normal tension range. Means are provided to restrict the rate of return movement of the second festooning roller to that which falls within the control limits of the first festooning roller, thus eliminating any tendency to accelerate the new supply roll to a speed above the desired machine operating speed.

6 Claims, 7 Drawing Figures

WEB TENSION CONTROL METHOD AND APPARATUS

BACKGROUND OF THE INVENTION

There are a substantial number of machines which perform operations on a tensionally fragile web of material. For example, in U.S. Pat. No. 3,802,942, to Amberg et al., there is disclosed a machine for forming a preprinted web of foam plastic material into a plurality of successive cylinders which are then applied around glass or plastic containers and subsequently shrunk into conforming engagement with such containers. The foam plastic material, which may be either foam polystyrene or a foamed polyethylene, does not have significant tension resistance and, since the machine operates by pulling the web of material from a supply roll, it is essential that the tension in the web be at all times maintained within a desired control range. Upon the depletion of one supply roll, it is customary to splice the end of the web to the beginning end of the web mounted on the new supply roll. This operation inherently would result in a very substantial increase in web tension, since the new supply roll is essentially stationary and must be accelerated by the web so that the linear speed of the web being drawn from the new supply roll corresponds to the operating speed of the machine.

Prior mechanisms for controlling web tension have involved the engagement of a shiftable festooning roller with the web. A substantially constant fluid pressure bias is imposed on the festooning roll in opposition to the web tension forces extended on the roller so that the roll shifts in response to variations in the web tension. Such shifting movements of the festooning roller are utilized to operate a hydralic valve unit which varies the amount of drag force applied to the supply reel. This general type of speed control arrangement is described in U.S. Pat. No. 3,862,724 to John R. Johnson et al.

When a single festooning roller is employed for the web tension control, it necessarily follows that the tension control range must be relatively broad so as to encompass not only the tension variation encountered during normal operation of the processing machine, but also to accomodate the very significant increase in web tension that could occur when the end of the web is spliced onto a new supply roll. Inherently, the requirement that a single roller accommodate such a wide range of potential web tension results in the web tension control not being particularly precise in the operating range. There is, therefore, a distinct need for a web tension control for tensionally fragile web material which will precisely maintain a desired control range of tension for normal operation conditions, and yet will accommodate the substantially increased tension that would otherwise result from the splicing operating when the end of the web is transferred for an empty roll to a fresh supply roll.

SUMMARY OF THE INVENTION

The method and apparatus provided by this invention involves the utilization of two separate festooning rollers for effecting web tension control of tensionally fragile webs of material. The one festooning roller is of conventional construction, engages a portion of the web and is shiftable as a function of the web tension to control a variable roll drag force producing means to maintain the web tension in a desired control range during normal operation of the machine. A second festooning roller or set of rollers is provided which is fluid pressure biased to an extreme position during the normal operation of the machine. The second festooning roller only becomes effective upon a significant increase in web tension above the normal control range, such as would tend to occur during the splicing of the end of the web to a new supply roll. This second festooning roller is not operatively connected with the drag force producing means but is effective solely by its displacement in response to the increased web tension to maintain the web tension within an acceptable limit during the acceleration of the new supply roll to machine speed. When the new supply roll reaches operating speed, however, the return movement of the second festooning roller to its normally inoperative extreme position is restricted to prevent the tendency of the supply roll to overspeed as a result of such return movement. The rate of return movement is reduced to that which can be conveniently accommodated by the normal control operation of the first festooning roller.

It follows that the method and apparatus of this invention not only eliminates the possibility of a dangerous increase in web tension occurring during the splicing operation as a result of the necessity for accelerating the new supply roll, but also eliminates improper functioning of the web supply apparatus due to the overspeeding of the new supply roll.

Further objects and advantages of the invention will be readily apparent to those skilled in the art from the following detailed description of a preferred embodiment thereof, taken in conjunction with the annexed sheets of drawings.

DESCRIPTION OF THE PREFERRED EMBODIMENT

Figure 1:
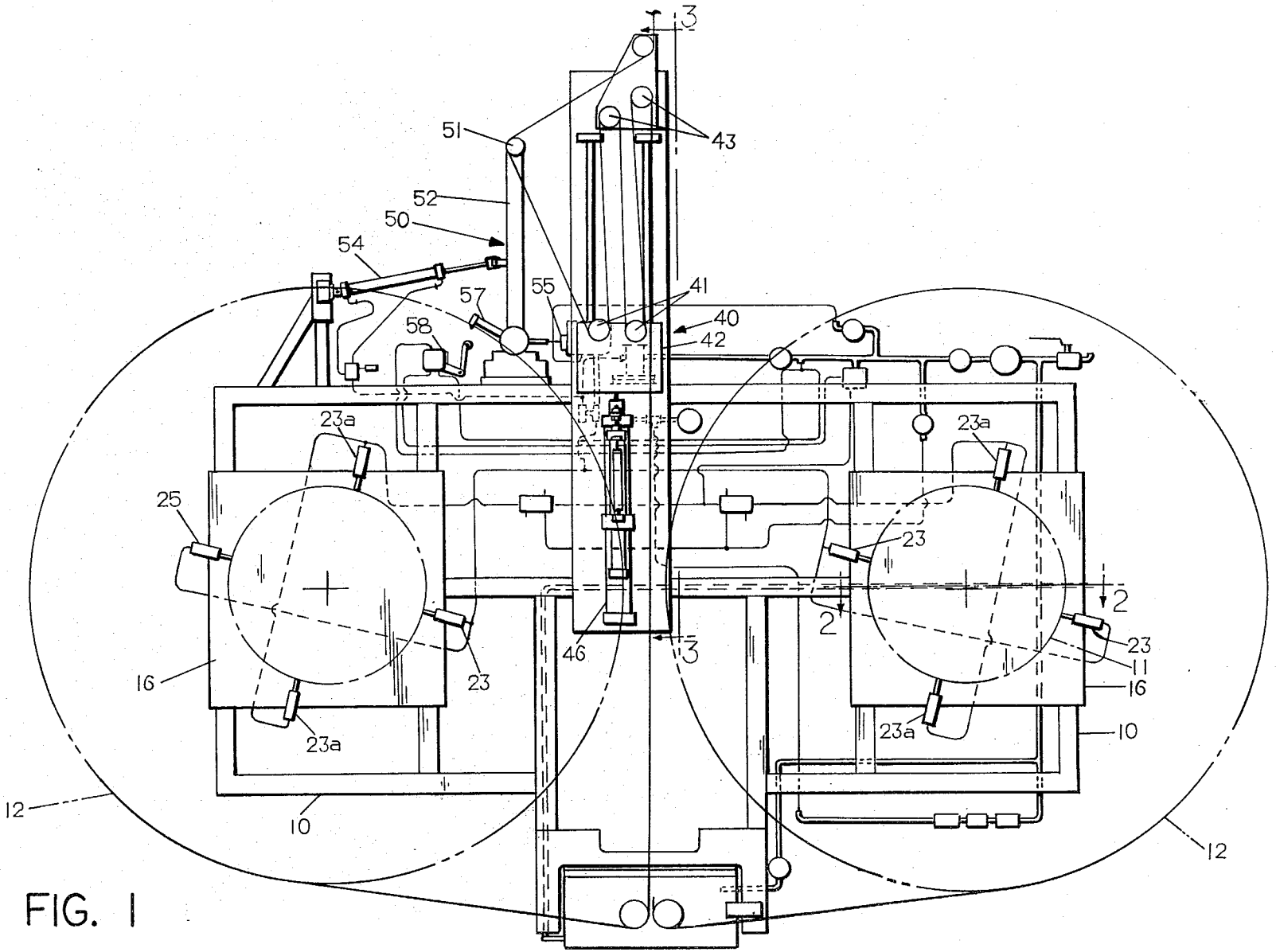
FIG. 1 is a plan view of a web supply mechanism incorporating a tension control embodying this invention.
Figure 2:
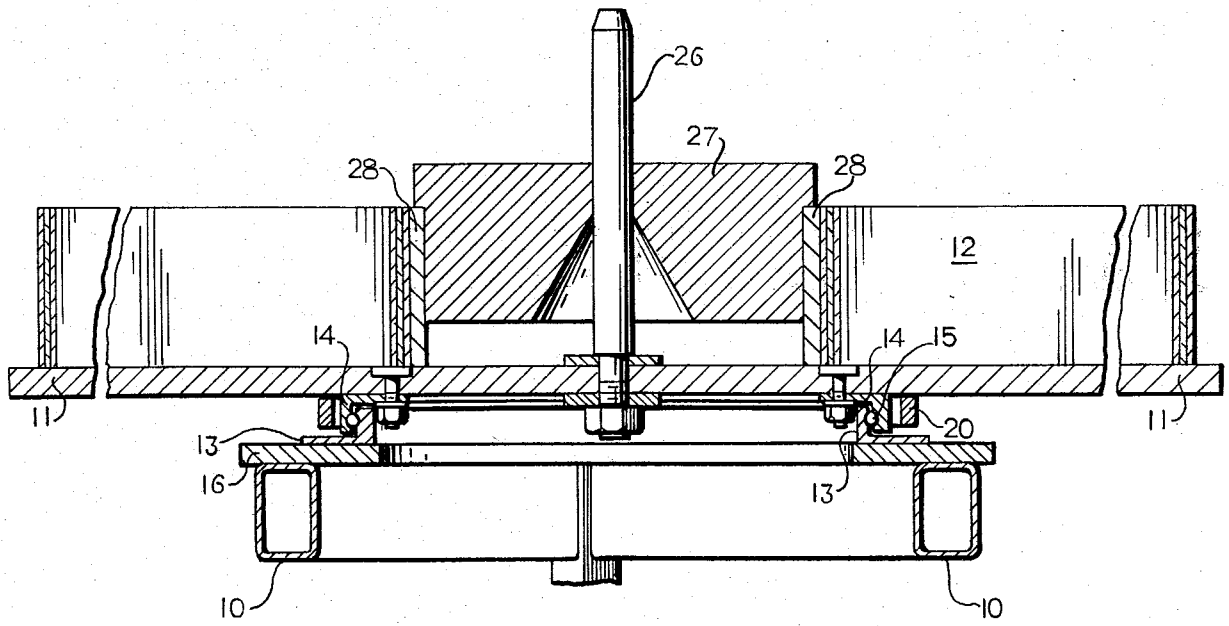
FIG. 2 is a vertical sectional view taken on the plane 2—2 of FIG. 1.

Referring to FIGS. 1 and 2, a web feeding apparatus is shown which is functionally quite similar to that described and illustrated in detail in U.S. Pat. No. 3,862,724 to Johnson et al. The apparatus incorporates an articulated welded frame structure 10 upon which a pair of identical turntables 11 are suitably journalled for rotation about horizontally spaced, vertical axes. Each turntable is constructed to support a roll of web like material 12 which, in a specific application of this invention, may comprise a web of foamed polystyrene which has very low tensile resistance. Two turntables 11 are used so that a minimum of time is lost in switching production to a second roll of material when the previous roll has been completely used. A pair of base plates 16 are attached to the top of the base 10 with one plate under each turntable assembly respectively.

As best seen in FIG. 2, each turntable 11 is mounted on the base 10 by means of a bearing assembly made of a circular inner bearing track 13 affixed to the base plate 16 and a depending, annular outer bearing track 14 affixed to the turntable 11. The two bearing tracks 13 and 14 each have formed therein a semicircular cross-section cavity which forms a bearing race for rotary ball bearings 15 which are deployed around the entire circumference of the tracks 13 and 14.

Base plate 16 is used not only as a support for the respective turntable 11, but also to accommodate the reel braking systems. Each turntable has two brake systems, including a pair of drag brakes 17 and a pair of stopping brakes 18. Each of the brake systems is similar, whether used as a drag or a stopping brake.

Figure 5:
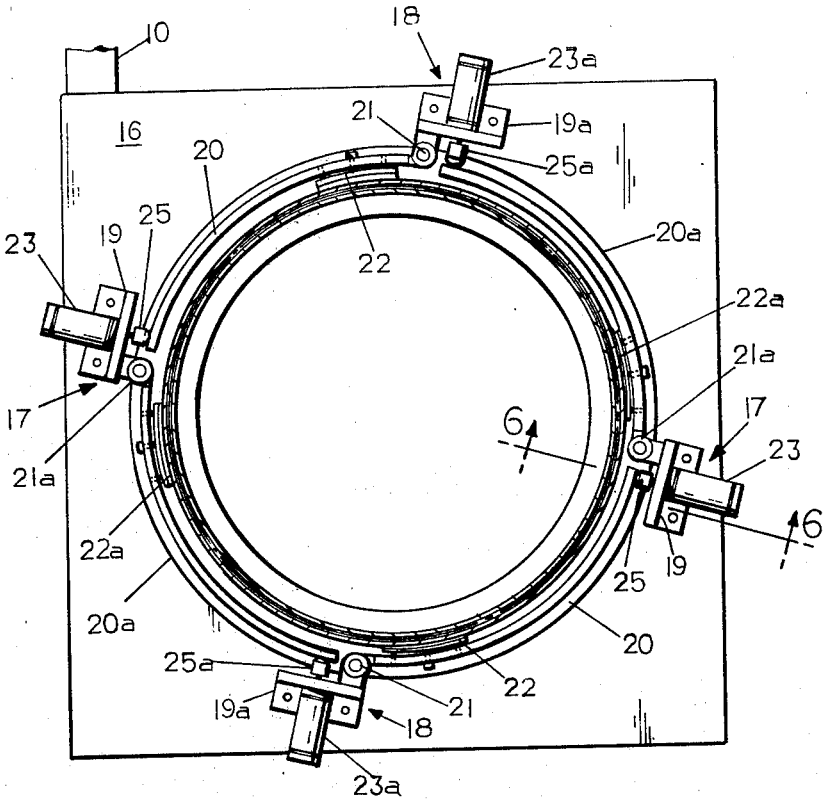
FIG. 5 is an enlarged scale plan view, with portions thereof shown in section, of the braking system provided for each turntable.
Figure 6:
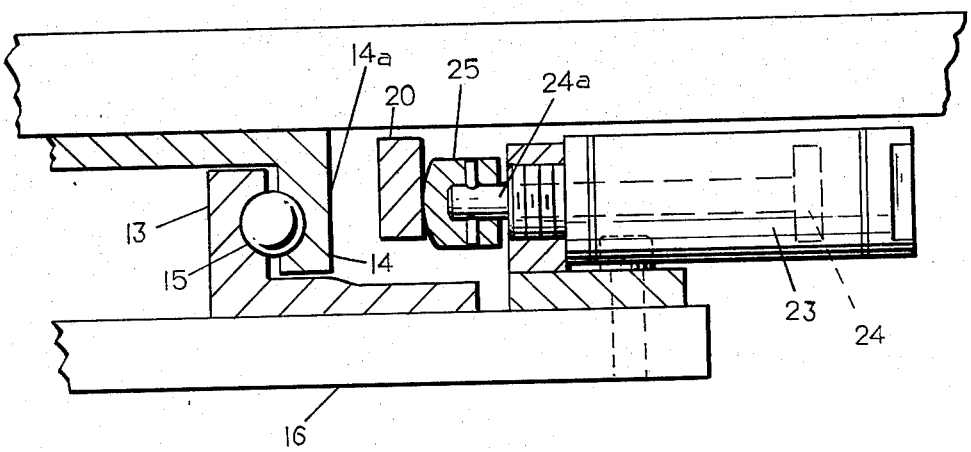
FIG. 6 is a vertical sectional view taken on the plane 6—6 of FIG. 5.

As shown in FIGS. 5 and 6, a pair of mounting brackets 19 are affixed to each base plate 16 in diametric relationship respectively for each drag brake assembly 17 and a pair of brackets **19*a* respectively for each stopping brake assembly 18. These mounting brackets are thus spaced at 90° intervals around the periphery of the outer bearing track 14. A drag shoe mounting arm 20 is hingedly attached to each stopping brake mounting bracket 19*a* by a hinge pin 21, allowing the drag brake shoe mounting arm 20 to pivot in the plane of the outer bearing track 14. A drag brake shoe pad assembly 22** is mounted to each drag brake shoe mounting arm for easy removal and replacement when worn.

A pneumatically operated drag brake cylinder 23 is mounted on each drag brake assembly mounting bracket 19. Each cylinder 23 has a piston mounted therein (not shown) and a piston rod 24 extending out one end of the cylinder. Each piston rod 24 has a piston cap 25 mounted thereon and facing radially inward to push against the end of the respective drag brake shoe mounting arm 20 at a point remote from the pivotal mounting of the particular mounting arm 20. Thus, when the two drag braking cylinders 23 are activated, pressure is applied to the free end of each drag brake shoe mounting arm 20 and in turn the drag brake shoe pads 22 are each forced against the outer surface **14*a* of the outer bearing track 14**.

The stopping brake systems 18 are similar to the previously described drag brake systems 17, and a stopping brake is mounted intermediate each of the drag brakes. Thus, a stopping brake shoe mounting arm **20*a* is hingedly attached to each drag brake mounting bracket 19 by a hinged pin 21*a*, allowing the stopping brake shoe mounting arm 20*a* to pivot in the plane of the outer bearing track 14. A stopping brake shoe pad assembly 22*a* is mounted to each stopping brake shoe mounting arm 20*a* for easy removal and replacement when worn. A pneumatically operated stopping brake cylinder 23*a* is mounted on each stopping brake assembly mounting bracket 19*a*. Each cylinder 23*a* has a piston mounted therein (not shown) and a piston rod 24*a* extending out one end. Each piston rod 24*a* has a piston cap 25*a* mounted thereon and facing radially inward to push against the end of each stopping brake shoe mounting arm 20*a* at a point remote from the pivotal mounting of the respective mounting arm 20*a*. Stopping brake cylinders 23*a* operate similar to drag brake cylinders 23, forcing the stopping brake shoe pads 22*a* against the outer braking surface 14*a* of the outer bearing track 14**.

Figure 4:
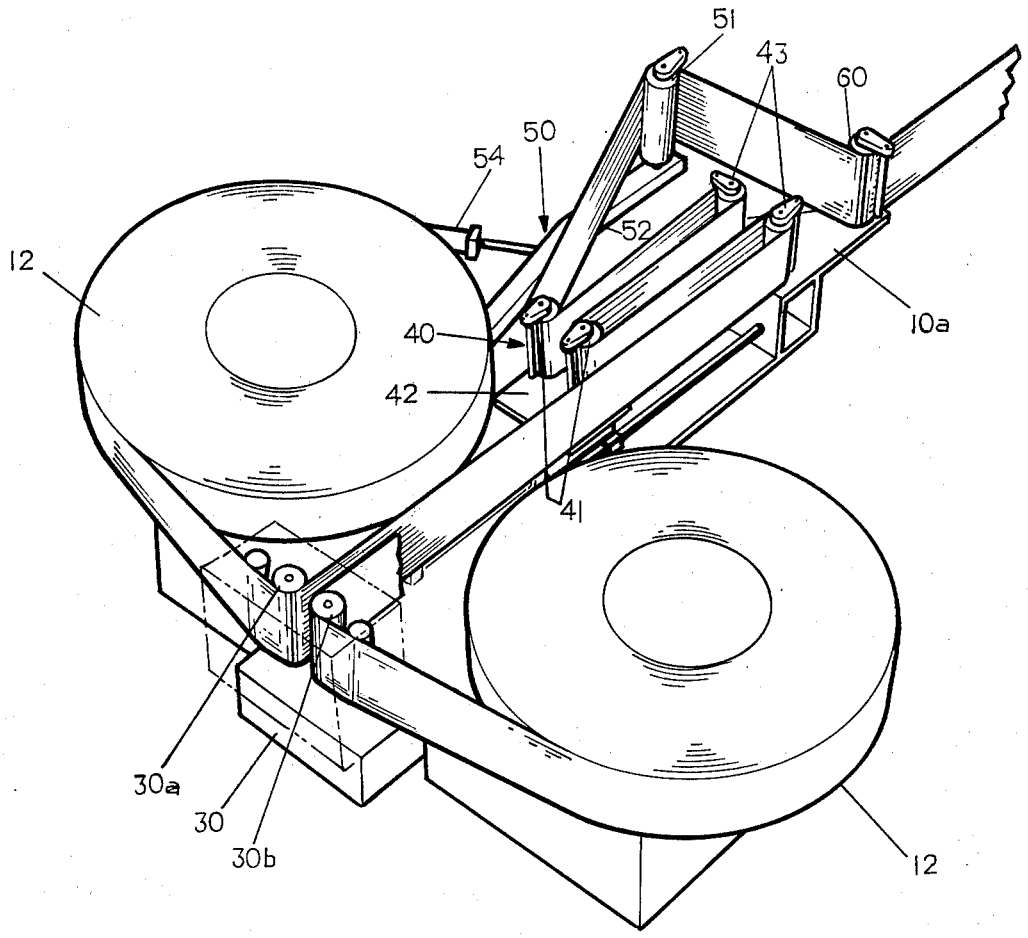
FIG. 4 is an enlarged scale, schematic perspective view of the web tension control portion of the apparatus of FIG. 1.

A roll of tensionally fragile web material 12 rests on either of the turntables 11 and is centered about an upstanding spindle 26 by a conventional centering fixture 27 which engages the core 28 on which web 12 is wound. During operation of the machine to which the web material 12 is applied, the roll of web material may be on either turntable 11. Referring to the schematic perspective view of FIG. 4, it will be assumed that the initial roll of web material 12 was placed on the left hand turntable 11. To unwind the web material, counterclockwise rotation of the roll 12 and the supporting turntable 11 is therefore required.

The web of material from the roll 12 is fed around one roller **30*a* of a conventional web splicing mechanism 30. A second roller 30*b* is provided around which is entrained the adhesively coated end of a web 12 supplied from a reel on the right hand turntable 11 when the supply of web material 12 on the left hand reel is near the point of exhaustion. The lateral positions of rollers 30*a* and 30*b* are manually controlled by conventional mechanism 30** to move the rollers together to bring the adhesively treated end surface of the new reel into intimate contact with the adjacent surface of the web being supplied from the left hand reel, and thus effect the splicing of the web from the new supply reel without interrupting the feeding of the web to the production machine.

It should be noted, however, that once the adhesive joint is produced, the tension in the web will tend to significantly increase, due to the fact that the web must accelerate the new supply reel to a rotational speed corresponding to the linear speed of movement of the web 12 produced by the production machine. To prevent this tension increase from reaching a point at which there is danger of severing the tensionally fragile material, a tension reducing mechanism 40 is provided. Such mechanism comprises a plurality of laterally spaced vertical rollers 41 which are mounted on a horizontally linearly movable carriage 42. Intermediate each roller 41 there is provided a cooperating idler roller 43 which are respectively mounted for horizontal rotation about fixed shafts 44 suitably mounted on a bracket **10*a* on the frame 10 of the machine. The web 12 is successively trained over the fixed rollers 43 and the movable rollers 41 and then passes around a horizontally laterally shiftable festooning roller 51 mounted on a conventional festooning lever type mechanism 50. From roller 51, the web 12 is then trained over a roller 60 which is mounted for rotation about a fixed vertical axis on a bracket 10*a*** and the web is drawn into the production machine from that point.

Figure 3:
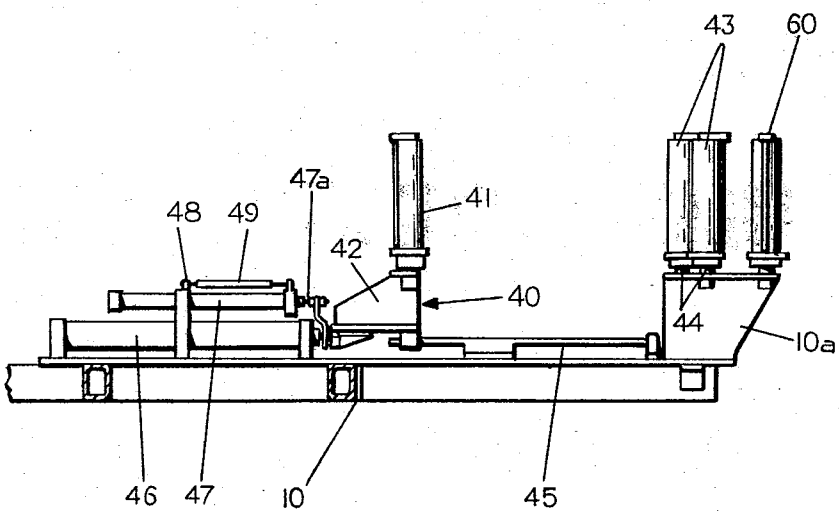
FIG. 3 is a partial vertical sectional view taken on the plane 3—3 of FIG. 1.

While the operation of the standard festooning roller unit 50 is well known in the prior art, a brief description of such will probably aid in the understanding of this invention. The mechanism 50 comprises a laterally shiftable web engaging roller 51 which is mounted on the free end of a horizontally pivoted festooning lever 52. As the tension increases, lever 52 pivots horizontally about its axis against the bias of a fluid pressure biasing cylinder 54, supplied from a constant pressure source (not shown in detail) and operates a hydraulic control valve unit 55 to supply fluid pressure to the drag brake cylinders 17 in proportion to the amount of pivotal movement of the festooning lever 52. Thus the tension is maintained at a desired level by increasing or decreasing the amount of drag imposed on the reel. Carriage 42 is shifted along the slide rods 45 by an increase in web tension and normally is biased against such movement by a single action fluid cylinder 46 connected to the same constant pressure source of fluid pressure as cylinder 54. During the normal operation of the production machine, the cylinder 46 is in its extreme retracted position as shown in FIG. 3 and the piston (not shown) of the cylinder would be in an extreme left hand position and maintained in such position by a constant fluid pressure which provides an effective biasing force greater than that exerted on rollers 41 by the normal range of web tension maintained by festooning roller mechanism 50. As the tension in the web material 12 increased due to the splicing operation, a linear force is imparted to the linearly shiftable rollers 41 to pull such rollers closer to the stationary rollers 43 and thus reduce the web tension. The only resistance to the movement of the rollers 41 is supplied by the fluid pressure applied within the cylinder 46.

Figure 7:
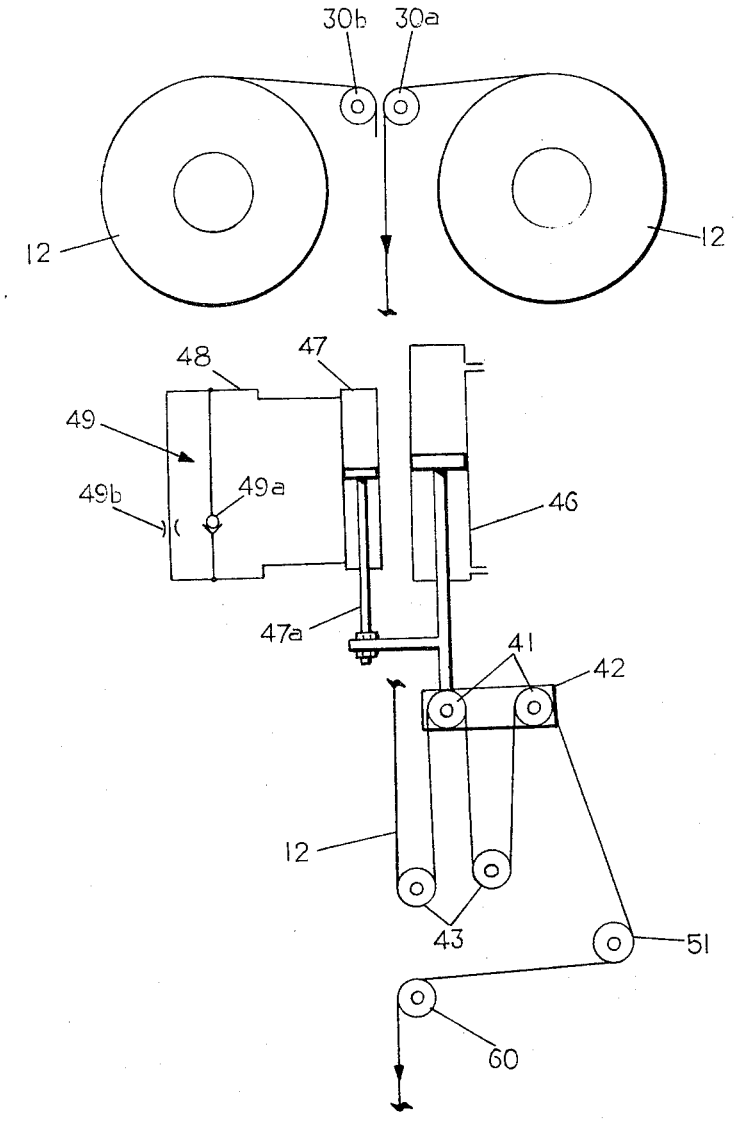
FIG. 7 is a schematic view of the web tension control apparatus showing the hydraulic connections of the over speed elimination cylinder.

In accordance with this invention, the piston rod of cylinder 46 is also connected to the piston 47*a* of a double acting hydraulic cylinder 47 which has opposite ends of its cylinder chamber interconnected by a conduit 48. To prevent overspeeding of the newly spliced supply roll, the conduit 48 (FIG. 7) includes a one way flow constriction 49, which permits unimpeded passage of liquid therethru during the movement of the double acting cylinder 47 corresponding to the movement of the single acting cylinder 46 to the right (as shown in FIG. 3) to relieve the web tension. Upon relief of such tension, however, the single acting cylinder 46 will attempt to return to its original position under the constant fluid pressure bias, but in cylinder 47 the flow rate of the return liquid is impeded by the flow constriction device 49 so that the double acting cylinder 46, hence carriage 42, returns to its normal position shown in FIG. 3 at a very slow rate. As shown in FIG. 7, flow constricting device 49 may include a check valve 49*a* connected in parallel with a flow limiting orifice 49*b*. Cylinder 47 thus functions as a unidirectional dash pot. This permits the normal festooning roller mechanism 50 to take over control of the web tension and maintain it within the desired control limits in conventional fashion.

The reason for delaying the retraction of the linearly shiftable festooning mechanism 40 under the influence of the fluid pressure bias within the singly acting cylinder 46 is simple. If there were no delay, the linearly movable festooning rollers 41 would retract and increase the web tension. This would result in a false signal to the conventional festooning mechanism 50 to decrease the drag forces on supply reel and hence permit such supply reel to overspeed. Instead, the provision of the constricted flow device 49 in the bypass 48 between the two sides of the piston in the double acting cylinder 47 permits only a gradual return of the single acting cylinder 46 and carriage 42 to its normal retracted position shown in FIG. 3.

The description of the construction and operation of the standard festooning roller mechanism 50, the reel drag brake system 17 and the reel stop brake system 18 has been quite abbreviated in view of the fact that this constitutes conventional apparatus, which is fully described and illustrated in the aforemention U.S. Pat. No. 3,862,724 to Johnson et al.

Those skilled in the art will recognize that modifications of the described apparatus embodying this invention are readily possible and it is intended that the scope of the invention be determined solely by the following claims.

We claim:

1. The method of controlling tension in a web of tensionally fragile material drawn by a constant speed web processing machine from either one of two supply rolls, wherein the web from one supply roll is spliced to the web from the other supply roll when the drawn web is shifted from one supply roll to the other, comprising the steps of:

(1) entraining a loop of the web around a first shiftable festooning roller, the position of said first festooning roller being determined by the difference between the web tension force exerted thereon and a constant fluid pressure force exerted on the first festooning roller by a first cylinder;

(2) applying a drag force to the supply roll which varies as a function of the displacement of the first festooning roller to maintain a controlled range of tension in the web;

(3) entraining another loop of the web around a second shiftable festooning roller, the position of said second festooning roller being determined by the difference between a constant fluid pressure force exerted on the second festooning roller by a second cylinder and the web tension force exerted on the second festooning roller, said second festooning roller being shiftable by a web tension force in excess of the normal operating tension in a direction to reduce web tension; and (4) restricting any movement of said second festooning roller in a direction to increase web tension to a rate within the control limits of said first festooning roller, whereby the fluctuations in web tension accompanying the splicing of the web to shift from one supply roll to the other may be absorbed by the second festooning roller.

2. Apparatus for controlling tension in a web of tensionally fragile material drawn by a constant speed web processing machine from either one of two supply rolls, comprising, in combination, a first festooning roller shiftably mounted adjacent to the web and engageable therewith to be shifted in opposite directions by increases or decreases of the web tension relative to a desired value; a first fluid pressure cylinder connected to said first festooning roller to exert a constant bias on said first festooning roller in opposition to the web tension forces on said first festooning roller; drag means opposing the rotation of each supply roll; means responsive to the shifting in position of said first festooning roller to vary the amount of drag force exerted by said drag means, thereby maintaining a controlled range of tension in the web; a second festooning roller shiftably mounted adjacent to the web and engageable with the web, a second fluid pressure cylinder interconnected with said second festooning roller and imparting a bias thereto in a direction opposing the web tension forces exerted on the second festooning roller, said bias being substantially greater than the normal web tension forces exerted on said second festooning roller so that said second festooning roller normally is positioned in one of its extreme positions of shiftable movement relative to said web when the web tension is in said control range; said second festooning roller being shiftable toward its other extreme position to reduce web tension upon the occurrence of a web tension significantly above said controlled range; and means for restricting the return movement of said second festooning roller toward said one extreme position to a rate which lies within the control limits of said first festooning roller.

3. Apparatus of claim 2 wherein said last mentioned means comprises a unidirectional dash pot connected to said second fluid pressure cylinder to impose a restriction only on the return movement of said cylinder to said one extreme position of said second festooning roller.

4. Apparatus of claim 1 or 2 plus a stationary axis roller, said second festooning roller being linearly shiftable relative to said stationary axis roller, and said web is entrained around said stationary axis roller and said second festooning roller.

5. Apparatus for controlling tension in a web of tensionally fragile material drawn by a constant speed web processing machine from either one of two supply rolls, comprising, in combination, a first festooning roller shiftably mounted adjacent to the web and engagable therweith to be shifted in opposite directions by increases or decreases of the web tension relative to a desired value; a first fluid pressure cylinder connected to said first festooning roller to exert a constant bias on said first festooning roller, drag means opposing the rotation of each supply roll; means responsive to the shifting in position of said first festooning roller to vary the amount of drag force exerted by said drag means, thereby maintaining a controlled range of tension in the web; a carriage mounted for linear reciprocal movement adjacent to the web; a fixed axis idler roller mounted adjacent to the path of said carriage and constructed and arranged to have said web entrained therearound; a pair of second festooning rollers mounted on said carriage and respectively engagable with said web before and after its engagement with said idler roller, whereby the linear movements of said carriage will increase or decrease the tension in said web; a second fluid pressure cylinder engagable with said carriage and imparting a bias thereto in a direction opposing the web tension forces exerted on the second festooning rollers carried by said carriage, said bias being substantially greater than the normal web tension forces exerted on said second festooning rollers so that said carriage is normally positioned in one of its extreme positions of shiftable movement relative to said web when the web tension is in said control range; said carriage being shiftable toward its other extreme position to reduce web tension upon the occurrence of a web tension significantly above said controlled range, and means for restricting the return movement of said carriage toward said one extreme position to a rate which lies within the control limits of said first festooning rollers.

6. Apparatus of claim 5 wherein said last mentioned means comprises a unidirectional dash pot connected to said second fluid pressure cylinder to impose a restriction only on the return movement of said cylinder to said one extreme position of said carriage.

* * * * *